US005331744A

United States Patent [19]

Rumsey

[11] Patent Number: 5,331,744

[45] Date of Patent: Jul. 26, 1994

[54] MARKER APPARATUS

[75] Inventor: Royce D. Rumsey, Laguna Beach, Calif.

[73] Assignee: Bandai America Incorporated, Cerritos, Calif.

[21] Appl. No.: 59,567

[22] Filed: May 12, 1993

[51] Int. Cl.[5] ..... B43L 11/00

[52] U.S. Cl. ..... 33/27.01; 33/18.1; 33/26; 33/562

[58] Field of Search ..... 33/27.01, 18.1, 26, 33/27.02, 27.04, 27.07, 27.11, 32.1, 32.2, 32.3, 562, 565, 566

[56] References Cited

U.S. PATENT DOCUMENTS

D. 165,849 2/1952 Jordan ..... 33/565 X
3,568,327 3/1971 Furuoka ..... 33/565
4,117,598 10/1978 Fisher ..... 33/27.11
4,391,045 7/1983 Fisher ..... 33/27.11
4,530,156 7/1985 Kettlestrings ..... 33/27.01
4,566,195 1/1986 Kulesza et al. ..... 33/27.11

FOREIGN PATENT DOCUMENTS 1229753 4/1971 United Kingdom ..... 33/565

*Primary Examiner*—Christopher W. Fulton
*Attorney, Agent, or Firm*—R. Gale Rhodes, Jr.

[57] ABSTRACT

Marker apparatus for using a marker to make a plurality of different designs on a surface including a design ring mounted rotatably on a base and including a plurality of apertures for receiving the marker and which provide the marker with a plurality of different movements with respect to the marking surface upon rotation of the design ring with respect to the base.

10 Claims, 6 Drawing Sheets

FIG. 2
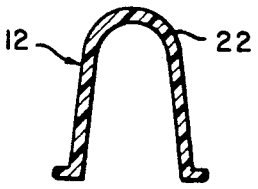
FIG. 3
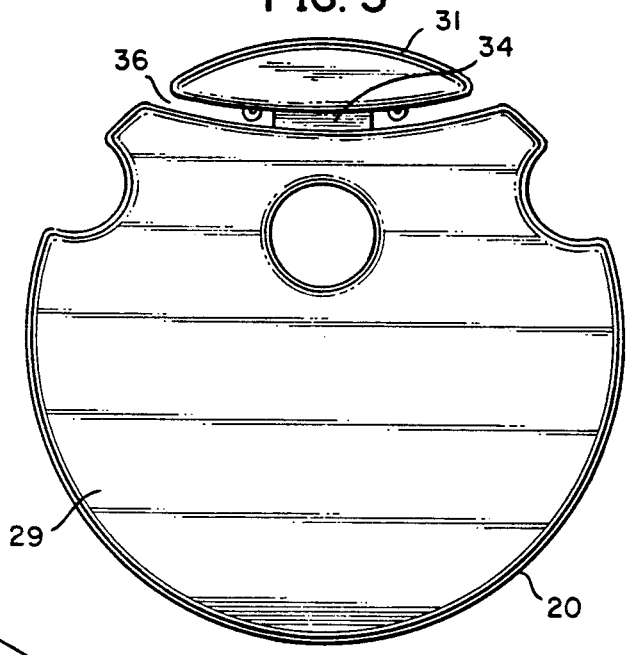
FIG. 4
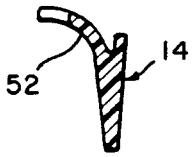
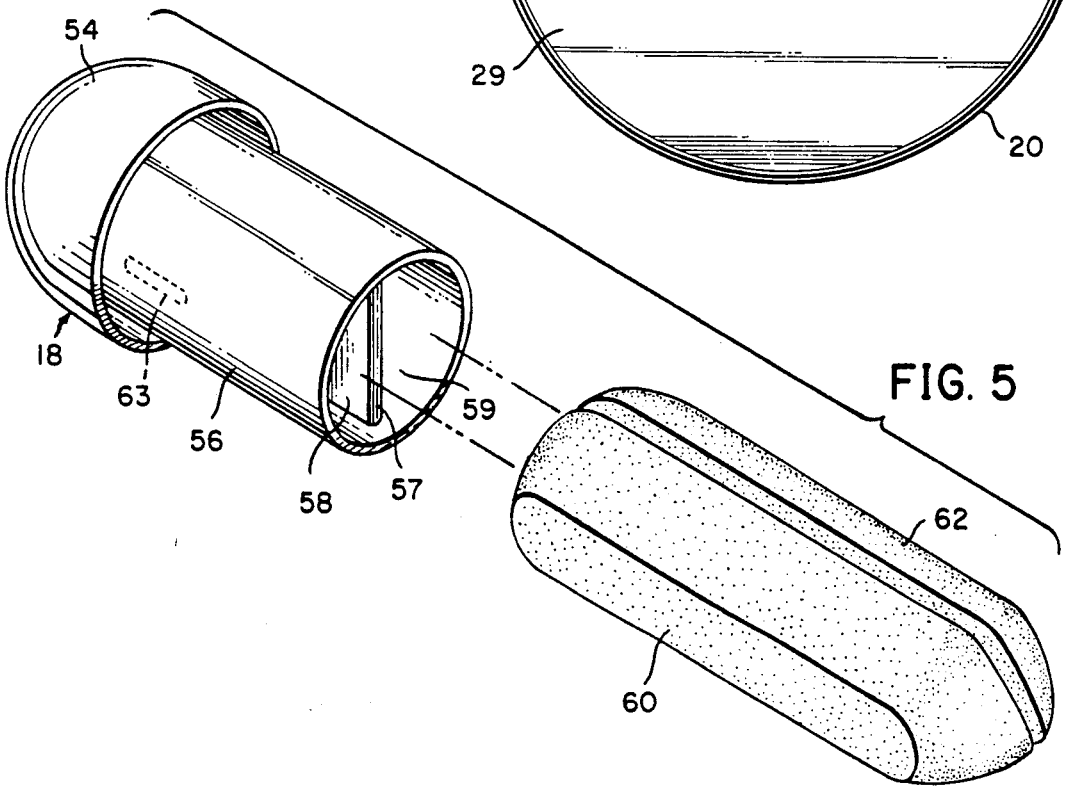
FIG. 5

MARKER APPARATUS

BACKGROUND OF THE INVENTION

This invention relates generally to new and improved apparatus with which a marker may be utilized to make a plurality of different designs on a surface, and more particularly this invention relates to new and improved apparatus with which chalk may be utilized to make a plurality of different designs on a surface such as a sidewalk.

The prior art is replete with apparatus for controlling the movements of a marker, such as a pencil, pen, chalk, crayon and the like, with respect to a marking surface to cause the marker to make a plurality of different designs on the marking surface. For example, templates or drafting devices are known to the art with which a marker may be utilized to make circles, triangles and the like on paper, and there is a device or toy known to the art sold under the trademark SPIROGRAPH® by the Kennet Corporation for controlling the movements of a marker, such as a pen or felt tipped marker, while the marker engages a surface, such as paper, and makes a plurality of different designs. However, here still exists a need in the art for a new and improved apparatus which may be utilized to make a plurality of different designs on a surface and in particular a need for a new and improved apparatus with which chalk may be utilized to make a plurality of different designs on a surface such as a sidewalk.

SUMMARY OF THE INVENTION

The object of the present invention is to satisfy the foregoing need in the art.

Apparatus satisfying such need and embodying the present invention may include a base for residing stationarily on a surface and providing a bearing surface, and a design ring for being mounted rotatably on said bearing surface and for holding and controlling the movement of a marker while the marker is engaging, is being moved with respect to, and is marking on the surface to provide the marker with a plurality of different movements with respect to the surface and to cause the marker to make a plurality of different designs on the surface.

DESCRIPTION OF THE DRAWINGS

FIG. 2 is a cross-sectional view taken generally along the line 2—2 in FIG. 1 in the direction of the arrows;

FIG. 3 is an enlarged plan view of one of the knee pads shown in FIG. 1;

FIG. 4 is a cross-sectional view taken generally along the line 4—4 in FIG. 1 in the direction of the arrows;

FIG. 5 is an enlarged perspective view of the marker holder member of the present invention and a pair of sticks of chalk;

DETAILED DESCRIPTION OF THE PREFERRED EMBODIMENT

Figure 1:
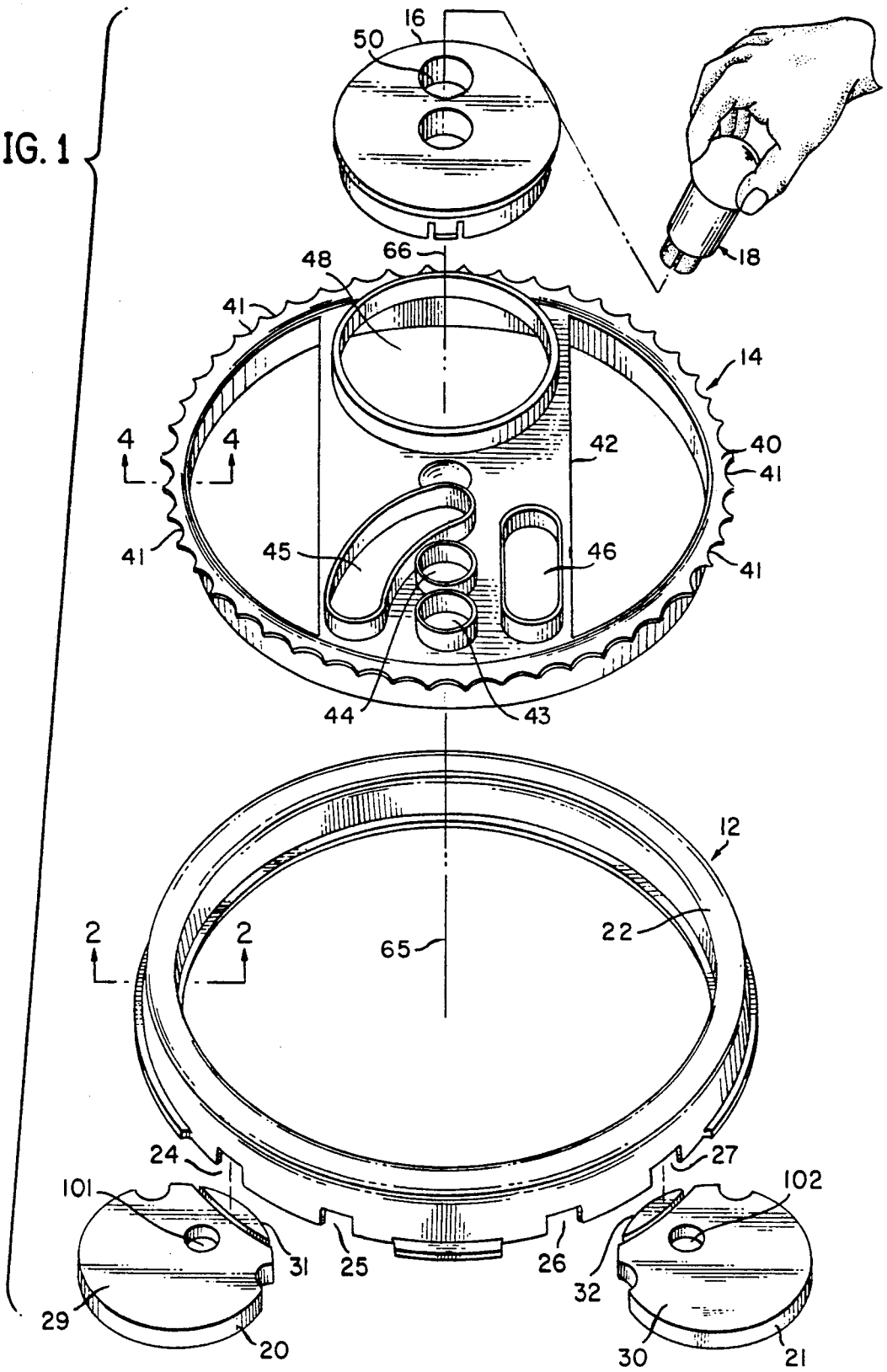
FIG. 1 is an exploded view of the apparatus of the present invention.

Referring now to FIG. 1, there is shown an embodiment of the apparatus of the present invention with which a marker may be used to make a plurality of different designs on a surface and which apparatus is indicated by general numerical designation 10. In a preferred embodiment, apparatus 10 may include an annular base indicated by general numerical designation 12, a design ring indicated by general numerical designation 14, a spinner disc 16, a marker holder member which in one preferred embodiment is a chalk holder member 18, and a pair of knee pads 20 and 21.

Base 12 provides a circular bearing surface 22 and, as may be understood by reference to FIG. 2, base 12 is provided with a generally inverted U-shaped cross-sectional shape. In addition, base 12 is provided with a plurality of inwardly extending slots 24, 25, 26 and 27 for mounting of the knee pads 20 and 21 to the base.

The knee pads 20 and 21 include knee receiving and supporting portions 29 and 30 and outwardly extending mounting portions 31 and 32. As may be better understood by reference to FIG. 3 and the enlarged plan view of representative knee pad 20, the mounting member portion 31 of the knee pad 20 is interconnected to the knee supporting portion 29 by a neck member 34 provided with a size and shape to permit the neck member to be wedgedly received within one of the inwardly extending slots 24 or 25 shown in FIG. 1 to mount the knee pad 20 to the base 12. It will be understood from FIG. 1 that the annular base 12 is provided with a curvature, or circularity, and it will be understood from FIG. 3 that the representative knee pad 20 is provided with an arcuate slot 36 conforming, or complementary in shape to, the curvature of the annular base 12 to facilitate the wedging of the neck member 34 into one of the slots 24 and 25 of the base 12. Upon the knee pad 20 being mounted to the base member 12 the arcuate slot 36 receives one or the other of the portions of the annular base 12 which surround and provide the upwardly extending slots 24 and 25 shown in FIG. 1. The knee pads 20 and 21 are for receiving and supporting the knees of a person, for example a child, using the apparatus 10 to make a plurality of different designs on a surface, such as for example, a sidewalk. The person kneels placing their knees of the knee supporting portions 29 and 30 of the knee pads 20 and 21, and depending upon the size of the person, the knee pad 20 may be mounted in either slot 24 or 25 and the knee pad 21 may be mounted in either slot 26 or 27 to vary or adjust the distance between the knee pads for the comfort of the person utilizing the apparatus 10 depending on the person's size.

Referring again to FIG. 1, it will be understood that the design ring 14 includes an annular member 40 and a cross member 42 extending diametrically across the annular member 40. The cross member 42 is provided with a plurality of apertures for receiving and holding the marker holder member 18 and which apertures may include the pair of circular apertures 43 and 44, an arcuate aperture or slot 45 and an elongated aperture or slot 46. The cross member 42 may be further provided with an enlarged circular aperture 48 for rotatably receiving the spinner disc 16. The spinner disc 16 is provided with a circular aperture 50 for receiving the marker holder member 18. The design ring 14 provides a circular bearing surface 52 better seen in FIG. 4 for rotatably engaging the circular bearing surface 22 provided by the base 12. In addition, the design ring 14 is provided with a plurality of inwardly extending indentations or notches 41 which in the embodiment described herein equal 48 in number.

Referring now to FIG. 5, it will be understood that in the preferred embodiment the marker holder member 18 may include a generally dome-shaped gripping or holding portion 54 and a generally hollow cylindrical portion 56 provided with a divider 57 which divides the cylindrical portion 56 into two marker holding compartments 58 and 59 which are generally semi-circular in transverse cross-sectional shape. In the preferred embodiment, the marker may be one or two sticks of chalk 60 and 62 which are also provided with a generally semi-circular transverse cross-sectional shape generally complementary to the transverse cross-sectional shape of the marker holding compartments 58 and 59. The transverse sizes and shapes of the compartments 58 and 59 and the sticks of chalk 60 and 62 are generally complementary to permit the sticks of chalk 60 and 62 to be wedgedly received in the compartments 58 and 59. The compartment 58 of the marker holder member 18 may be provided with a member 63 making the compartment 58 shorter in length than the compartment 59 to facilitate holding of used or broken sticks of chalk in the shorter compartment 58 with the new and longer sticks of chalk being held in the compartment 59. The outer diameter of the cylindrical portion 56 of the marker holder member 18 is dimensioned to permit the portion 56 to be received and held movably with respect to the apertures 43–46 and 50.

Figure 6:
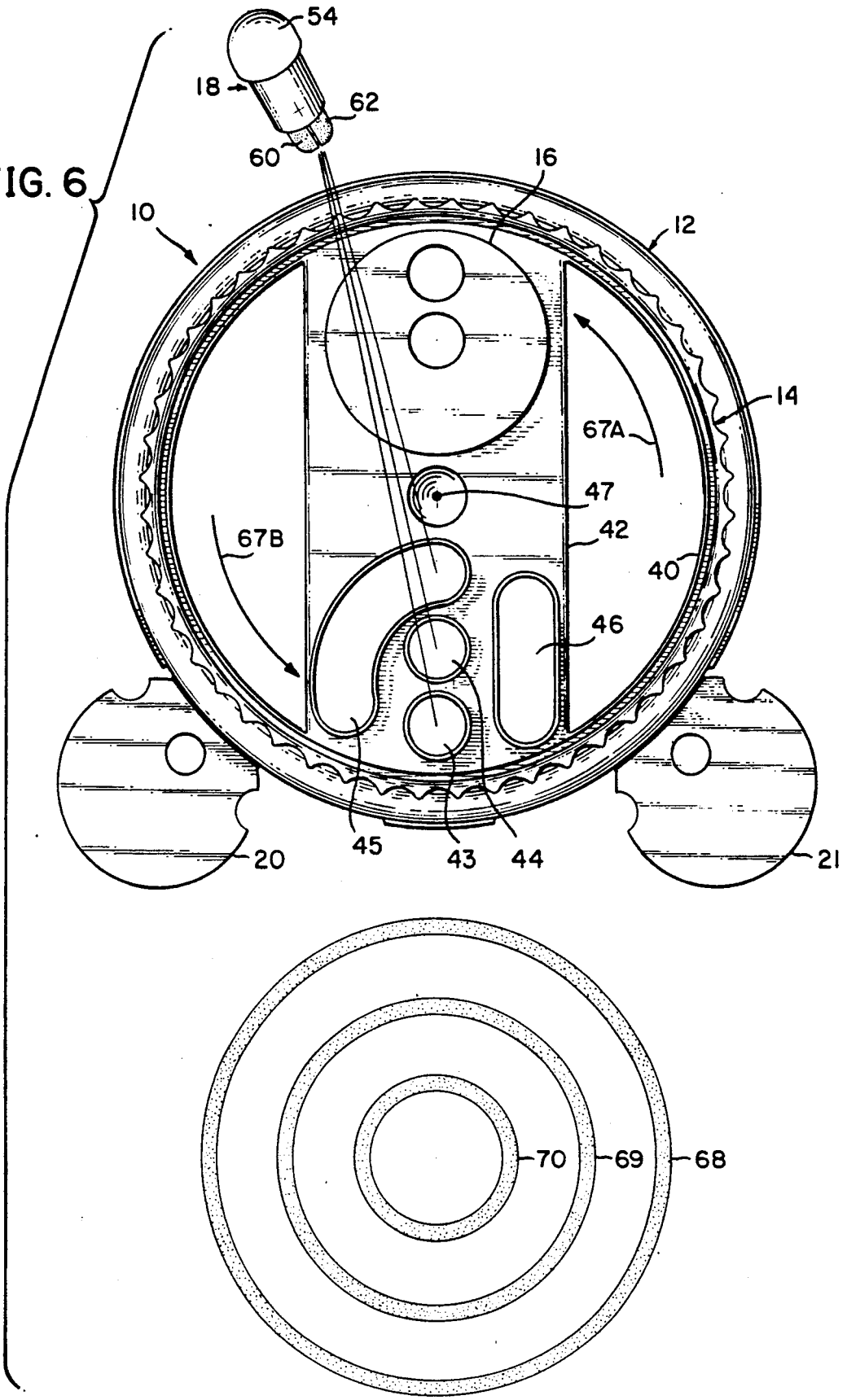
FIG. 6 is a composite view including a plan view of the apparatus of the present invention and a diagrammatical illustration of a design which may be made by a marker utilizing the present invention.

Referring now to FIG. 6, it will be presumed that the base 12, design ring 14 and spinner disc 16, shown in FIG. 1 and described above, have been assembled as indicated by the assembly lines 65, 66 shown in FIG. 1 and that the sticks of chalk 60 and 62, FIG. 5, have been wedgedly received within the compartments 58 and 59 of the marker holder member 18 and that the knee pads 20 and 21 have been mounted to the base 12 as described above. It will be further presumed that the apparatus 10 has been placed over and that the base 12 is residing on a suitable marking surface, such as for example, a sidewalk. It will be noted that the design ring 14 has a center of rotation 47 and that the apertures 43, 44 and the inner portion of the arcuate aperture or slot 45 are different distances from such center of rotation. The marker holder member 18 may be first inserted in and held by the circular aperture 43 to place the sticks of chalk 60 and 62 in engagement with the above-mentioned sidewalk. A person kneels on the knee pads 20 and 21, grips the holding portion 54 of the marker holder member 18, and using the holder or gripping portion 54 rotates the design ring 14 with respect to the base 12 in the direction of the arrows 67A and 67B to cause the sticks of chalk 60 and 62 to be rotated with respect to the base 12 and the aforementioned sidewalk to cause the sticks of chalk to mark the larger circular design ring 68 on such sidewalk; since the knee pads 20 and 21 are mounted to the base 12 and since the person is kneeling on the knee pads the base 12 will be held stationarily on such sidewalk while the design ring 14 is being rotated. Thereafter, the marker holder member 18 may be inserted and held in the circular aperture 44 and the above-described marking process is repeated to cause the sticks of chalk 60 and 62 to mark the design ring 69 on the side walk. Thereafter, the marker holder member 18 may be inserted in and held in the upper portion of the arcuate aperture or slot 45 and the above-described marking process is repeated to cause the sticks of chalk 60 and 62 to mark the ring 70 on such sidewalk.

Figure 7:
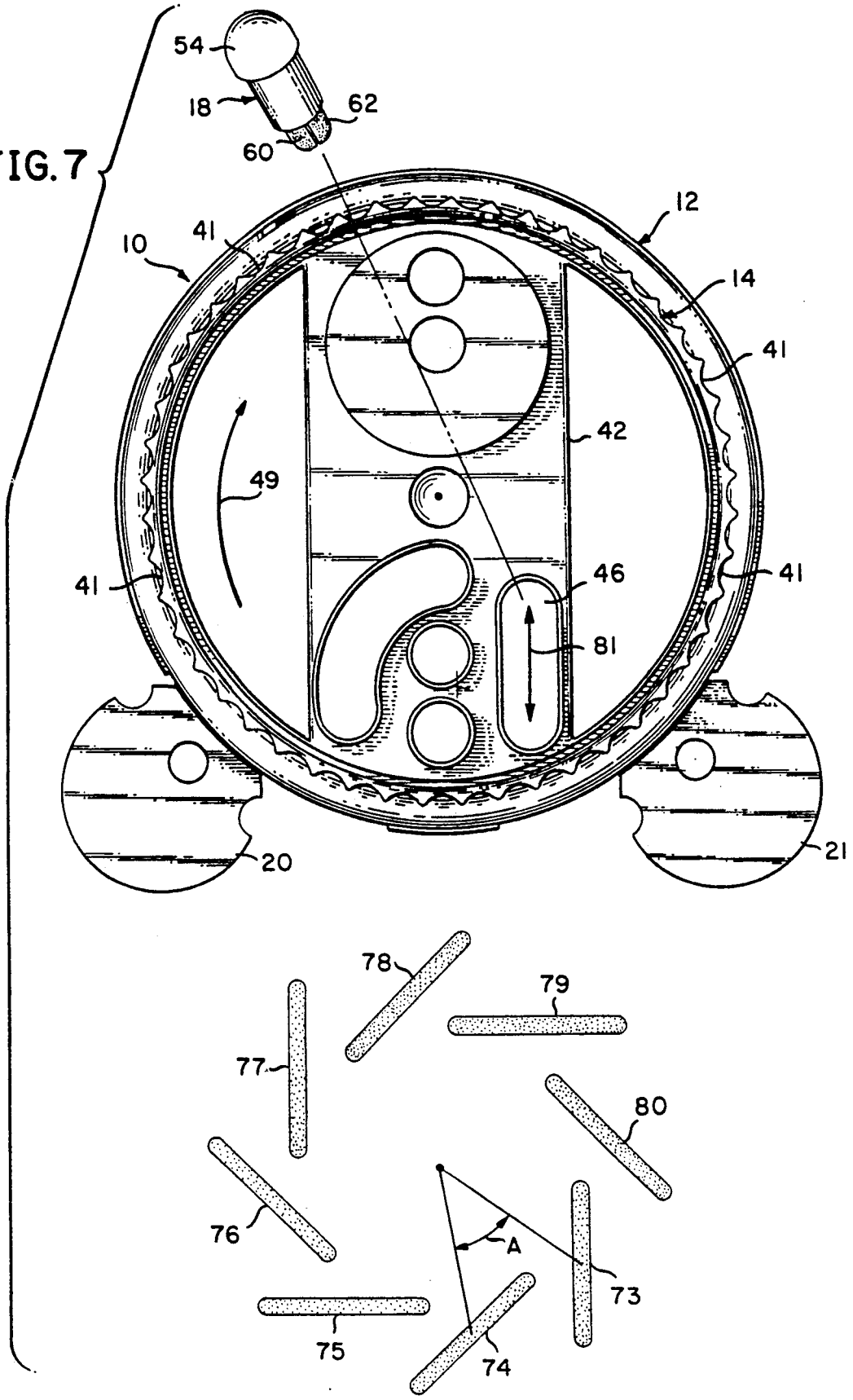
FIG. 7 is a composite view including a plan view of the apparatus of the present invention and a diagrammatical illustration of another design which may be made by a marker utilizing the present invention.

The manner in which the apparatus 10 of the present invention may be utilized with a marker, such as the chalk 60 and 62, to provide a design on a marking surface, such as the above-mentioned sidewalk consisting of a plurality of generally radially extending and angularly displaced straight marks 73 . . . 80 is illustrated diagrammatically in FIG. 7. It will again be presumed that the components of the apparatus 10 of the present invention have been assembled as described above, that the apparatus has been placed over a suitable marking surface such as the above-mentioned sidewalk, and that a person such as a child is kneeling on the knee pads 20 and 21 whereupon such person utilizing the apparatus 10 will use one hand to grip the portion 54 of the marker holder member 18 to place the marker holder member 18 in the elongated slot 46 and such person will use the other hand to simultaneously hold or grip the base 12 and design ring 14 to cause the design ring 14 to be positioned stationarily with respect to the base 12. The person will then move the marker holder member 18 up and down or back and forth as indicated by the double headed arrow 81 in FIG. 7 to mark, for example, the straight mark 73 on such sidewalk. Thereafter, the person will place one hand on the base 12 and place the thumb of such hand into relatively light engagement with the design ring 14 and will rotate the design ring in the direction of arrow 49, a predetermined number of rotational steps with respect to the base 12 by counting the number of notches or indentations 41 which pass by such thumb. For example, and as noted above, the design ring 14 may be provided with 48 indentations or notches 41 and to make the design shown in FIG. 7 consisting of the eight straight marks 73–80, the person will rotate the design ring 14 in six rotational steps with respect to the base 12 by counting six indentations or notches passing such thumb. Such six rotational steps will cause the design ring 14 to be rotated with respect to the base 12, or be displaced an angular distance with respect thereto, as illustrated by the angle A in FIG. 7. Thereafter, the person will use one hand to simultaneously grip the base 12 and design ring 14 to position the design ring 14 stationarily with respect to the base 12 and will use the other hand to move the marker holder 18 back and forth in elongated slot 46 as indicated by the double headed arrow 81 to mark the straight mark 74 on such sidewalk, and it will be understood, that the straight line 74 is displaced angularly with respect to the previously marked straight line 73 by the angle A. Similarly, the design ring 14 will thereafter be rotated in additional increments of six additional rotational steps and the above described marking process will be repeated to mark the straight lines 75–80 on such sidewalk.

Figure 8:
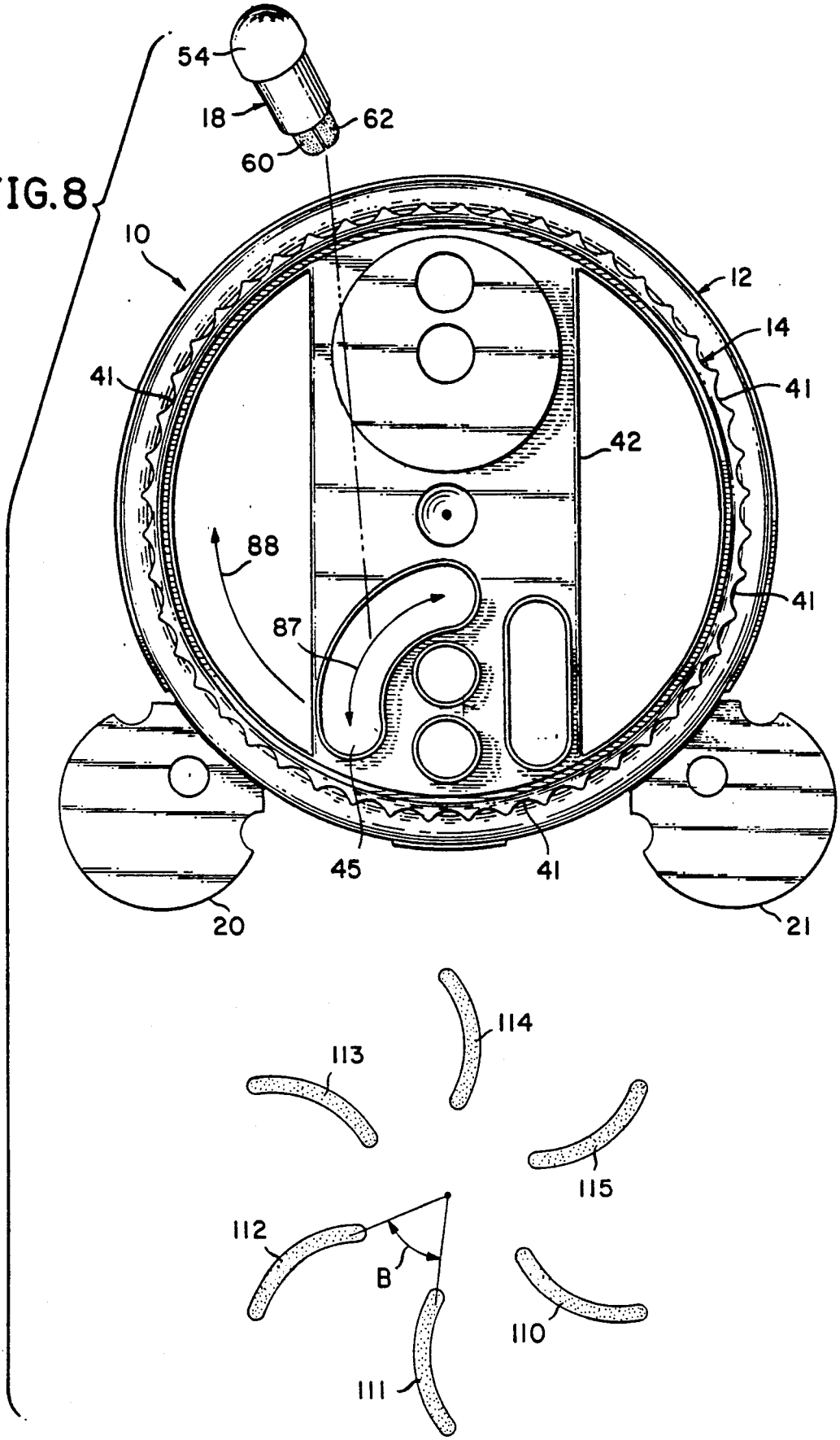
FIG. 8 is a composite view including a plan view of the apparatus of the present invention and a diagrammatical illustration of another design which may be made by a marker utilizing the present invention.

Referring now to FIG. 8, it will be further understood that the apparatus 10 of the present invention may be utilized with the sticks of chalk 60 and 62 to mark a design on a surface such as the above-noted sidewalk which design consists of the plurality of generally radially extending and angularly displaced arcuate marks 110 . . . 115 shown in FIG. 8. The above-noted person will use one hand to place the marker holder member 18 in the arcuate slot 45 and will use the other hand to hold the design ring 14 stationary with respect to the base 12 and will move the marker holder 18 back and forth arcuately in the arcuate slot 45 as indicated by the double headed arrow 87 to mark, for example, the arcuate mark 110 on such sidewalk. Thereafter, the person will use one hand to grip the base 12 and will place the thumb of such hand into light engagement with the design ring 14, provided with the above-noted 41 indentations, in the direction of the arrow 88 and will rotate the design ring 14 eight rotational steps with respect to the base 12 by counting eight indentations or notches 41 passing such thumb. Thereafter, the person will use one hand to hold the design ring 14 stationary with respect to the base 12 and will again use the marker holder 18 to move the sticks of chalk 60 and 62 arcuately back and forth in the arcuate slot 45 as indicated by the double headed arrow 87 to mark the arcuate mark 111 on such sidewalk. By rotating the design ring 14 such eight rotational steps with respect to the base 12, it will be understood that the design ring and sticks of chalk 60 and 62 will be rotated or displaced angularly with respect to the base 12 and the underlying sidewalk as indicated by the angle B and it will be further understood that the arcuate marks 110 and 111 also will be displaced angularly by the angle B. Similarly, the design ring 14 will thereafter be rotated in additional increments of eight additional rotational steps and the above-described marking process will be repeated to mark the arcuate lines 112–115 on such sidewalk.

Figure 9:
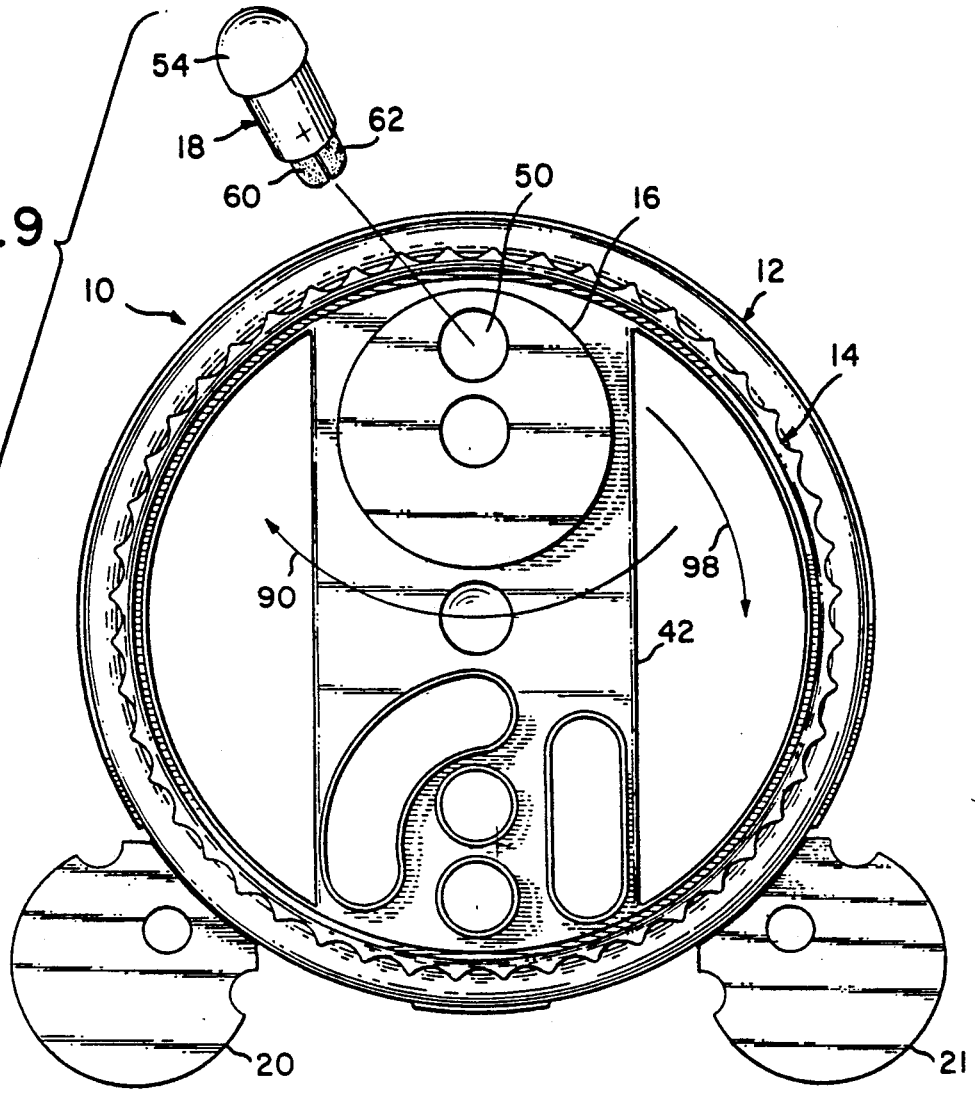
FIG. 9 is a composite view including a plan view of the apparatus of the present invention and a diagrammatical illustration of another design which may be made by a marker utilizing the present invention.
Figure 9:
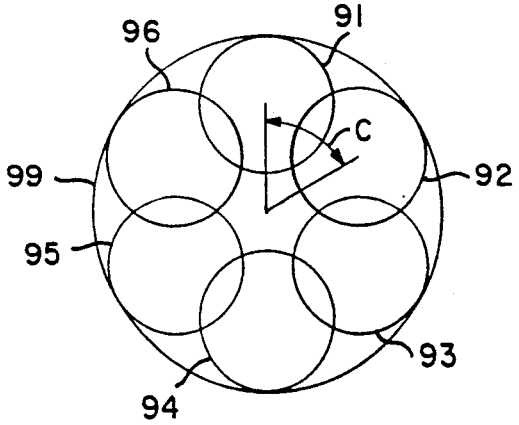

It will be further understood that a person, such as the above-noted child, may use the apparatus 10 of the present invention to mark the design shown in the lower portion of FIG. 9 on a surface, such as for example, the above-noted sidewalk. Such person may kneel on the knee pads 20 and 21, use one hand to position the design ring 14 stationarily with respect to the base 12, and use the other hand to insert the marker holder 18 into the aperture 50 of the spinner disc 16. Such person may then use the marker holder 18 to rotate the spinner disc 16 to cause the sticks of chalk 60 and 62 to engage such sidewalk and mark the circle 91 shown below in FIG. 9 on such sidewalk. Thereafter, the person will grip the base 12 with one hand with the thumb of such hand resting lightly on the design ring 14 and will rotate the design ring using the holder 18 in the direction of the arrow 98 and will count eight indentations or notches passing such thumb whereupon the person will again grip the design ring 14 to position it stationarily with respect to the base 12. The person will use the other hand to again rotate the spinner disc 16 using the marker holder 18 to cause the chalk 60 and 62 to mark the circle 92 on such sidewalk. It will be understood that by rotating the design ring 14 the eight counted notches with respect to the base 12 the circle 92 will be displaced angularly with respect to the circle 91 by the angle C. Similarly, the design ring 14 will thereafter be rotated in additional increments of eight additional rotational steps, and the above marking process will be repeated to mark the additional circles 93–96 on such sidewalk. If desired, such person may also mark the outer circle or ring 99 on such sidewalk in the same manner that circle 68 shown in FIG. 6 was marked on the sidewalk. If desired, the circles 69 and 70 shown in FIG. 6 may also be marked on the sidewalk to become part of the design shown in the lower portion of FIG. 9. It will be further understood that instead of marking the complete circles 91–96, the spinner disc 16 may be used to mark angularly displaced portions of a circle which portions may be either connected or disconnected as desired and as determined by the person performing such marking.

Referring again to FIG. 1 and in particular to FIG. 3, it will be understood that the knee pads 20 and 21 may be provided with interior apertures 101 and 102, and instead of the person kneeling on the knee pads with both knees, the person may kneel on one knee pad and lean on the other knee pad with a hand and may place the thumb of such hand in one of the apertures to place the base 12 in stationary engagement with the underlying surface such as the above-mentioned sidewalk.

It will be understood by those skilled in the art that many modifications and variations may be made in the present invention without departing from the spirit and the scope thereof.

What is claimed is:

1. Apparatus with which a marker may be utilized to make a plurality of different designs on a surface, comprising:

base means for residing stationarily on said surface and providing a first circular bearing surface;

a design ring including an annular member provided with a second circular bearing surface for rotatably engaging said first bearing surface and further including a cross member extending generally diametrically across said annular member and provided with a plurality of apertures for holding said marker while said marker is engaging, is being moved with respect to, and is marking on said surface to provide said marker with a plurality of different movements with respect to said surface and to cause said marker to make said plurality of different designs on said surface; and a pair of knee pads for receiving and protecting the knees of a person from said surface upon said person kneeling upon said knee pads and utilizing said apparatus to make said plurality of different designs on said surface, and wherein such knee include knee supporting portions and outwardly extending mounting portions for mounting said knee pads to said base means.

2. Apparatus according to claim 1 wherein said design ring includes an outer peripheral portion provided with a plurality of inwardly extending indentations to permit a person to place a thumb on said base means and rotate said design ring with respect to said base means in a plurality of predetermined rotational steps by counting the number of indentations which pass said thumb as said design ring is rotated by said person with respect to said base means.

3. Apparatus according to claim 1 wherein one of said apertures is an elongated slot for holding said marker and for causing said marker to make a plurality of generally radially extending and angularly displaced marks on said surface upon said marker being moved in said slot and upon said design ring being rotated in a plurality of predetermined rotational steps with respect to said base and said surface.

4. Apparatus according to claim 1 wherein one of said apertures is an arcuate slot for holding said marker and for causing said marker to make a plurality of generally radially extending and angularly displaced arcuate marks on said surface upon said marker being moved in said arcuate slot and upon said design ring being rotated in a plurality of predetermined rotational angular steps with respect to said base and said surface.

5. Apparatus according to claim 1 wherein said circular design ring has a center of rotation and wherein a predetermined plurality of said apertures are spaced different distances from said center of rotation and wherein said plurality of apertures are for causing said marker to make a plurality of circles of different diameters on said surface upon said design ring being rotated about said center of rotation with respect to said base and said surface.

6. Apparatus according to claim 1 wherein said apparatus further comprises a spinner disc mounted rotatably on said cross member for rotation with respect thereto and wherein said spinner disc includes an aperture for holding said marker to cause said marker to make a plurality of generally circular designs on said surface upon said spinner disc being rotated with respect to said cross member and upon said design ring being rotated in a plurality of predetermined rotational steps with respect to said base means and said surface.

7. Apparatus according to claim 1 wherein said base means includes an outer peripheral portion provided with a plurality of upwardly extending slots and wherein said mounting portions of said knee pads include outer base member engaging portions interconnected to said knee supporting portions by neck members and wherein said neck members are for being wedgedly received within said upwardly extending slots formed in said base means.

8. Apparatus according to claim 7 wherein said base means is provided with a curvature and wherein said knee pads are provided with arcuate slots conforming to said curvature and wherein said arcuate slots are for receiving portions of said base means providing said upwardly extending slots.

9. Apparatus according to claim 1 wherein said apparatus further comprises a marker holder member for holding said marker and said marker holder member for being held in said plurality of different apertures.

10. Apparatus according to claim 1 wherein said base means is generally annular and is provided with a generally inverted U-shaped cross-sectional shape.

* * * * *